US006415889B1

(12) United States Patent
Wyatt

(10) Patent No.: US 6,415,889 B1
(45) Date of Patent: Jul. 9, 2002

(54) STAMPED-FORMED MUFFLER APPARATUS AND ASSEMBLY PROCESS

(75) Inventor: Robert H. Wyatt, Columbus, IN (US)

(73) Assignee: ArvinMeritor, Inc., Troy, MI (US)

( * ) Notice: Subject to any disclaimer, the term of this patent is extended or adjusted under 35 U.S.C. 154(b) by 0 days.

(21) Appl. No.: 09/601,129

(22) PCT Filed: Jan. 29, 1999

(86) PCT No.: PCT/US99/01975

§ 371 (c)(1),
(2), (4) Date: Jul. 27, 2000

(87) PCT Pub. No.: WO99/39087

PCT Pub. Date: Aug. 5, 1999

Related U.S. Application Data

(60) Provisional application No. 60/073,151, filed on Jan. 30, 1998.

(51) Int. Cl.[7] ..... F01N 7/18

(52) U.S. Cl. ..... 181/282; 181/243; 181/264; 181/227; 29/890.08

(58) Field of Search ..... 181/282, 243, 181/264, 265, 270, 268, 271, 275, 227; 29/890.08

(56) References Cited

U.S. PATENT DOCUMENTS

| | | | | |
|---|---|---|---|---|
| 2,066,467 A | | 1/1937 | Gray | |
| 2,070,543 A | | 2/1937 | Cary et al. | |
| 2,274,460 A | | 2/1942 | Rauen | |
| 2,484,826 A | | 10/1949 | Harley | |
| 3,100,140 A | * | 8/1963 | Ashley et al. | 165/166 |
| 3,125,182 A | | 3/1964 | Earley | |
| 3,209,859 A | | 10/1965 | Lentz et al. | |
| 3,638,756 A | | 2/1972 | Thiele | |
| 3,724,591 A | * | 4/1973 | Malkiewicz | 181/265 |
| 3,827,529 A | | 8/1974 | Frietzsche et al. | |
| 4,079,810 A | | 3/1978 | Prather et al. | |
| 4,132,286 A | | 1/1979 | Hasui et al. | |
| 4,164,266 A | | 8/1979 | Collin et al. | |
| 4,185,715 A | | 1/1980 | Reu Boiu | |
| 4,415,059 A | | 11/1983 | Hayashi | |
| 4,456,091 A | | 6/1984 | Blanchot | |
| 4,637,491 A | | 1/1987 | Fukuda | |
| 4,673,058 A | | 6/1987 | Roberts et al. | |
| 4,744,233 A | | 5/1988 | Trudell | |
| 4,756,383 A | | 7/1988 | Sterrett | |
| 4,836,330 A | | 6/1989 | Harwood et al. | |
| 4,860,853 A | | 8/1989 | Moring, III | |
| 4,901,816 A | | 2/1990 | Garey | |
| 4,909,348 A | | 3/1990 | Harwood et al. | |
| 4,928,372 A | | 5/1990 | Harwood et al. | |
| 4,941,545 A | | 7/1990 | Wilcox et al. | |
| 4,953,660 A | | 9/1990 | Jewell, Jr. et al. | |
| 5,119,551 A | | 6/1992 | Abbott | |
| 5,147,987 A | | 9/1992 | Richardson et al. | |
| 5,187,334 A | | 2/1993 | Abbott et al. | |
| 5,216,809 A | | 6/1993 | Abbott et al. | |
| 5,229,557 A | | 7/1993 | Allman et al. | |

(List continued on next page.)

FOREIGN PATENT DOCUMENTS

| | | | | |
|---|---|---|---|---|
| GB | 2 120 318 A | | 11/1983 | |
| JP | 59-41618 | | 3/1984 | |
| JP | 59-43456 | | 12/1984 | |
| JP | 56-154512 | | 12/1984 | |
| JP | 02298621 A | * | 12/1990 | F01N/07/18 |

*Primary Examiner*—Robert E. Nappi
*Assistant Examiner*—Edgardo San Martin
(74) *Attorney, Agent, or Firm*—Barnes & Thornburg

(57) ABSTRACT

A muffler and method of making a muffler is disclosed wherein the muffler is formed from a single sheet showing four portions separated by three folds lines and wherein the two center portions are formed with tube outlines such that when the center portions are folded 180°, the tube outlines on the center portions abut to provide an exhaust path and wherein the two outer portions are folded over one of the center portions respectively to define two chambers surrounding the tubes and wherein end caps are provided to enclose the chambers.

40 Claims, 7 Drawing Sheets

U.S. PATENT DOCUMENTS

| | | | | | |
|---|---|---|---|---|---|
| 5,252,788 | A | | 10/1993 | Emrick et al. | |
| 5,563,385 | A | | 10/1996 | Harwood | |
| 5,597,986 | A | | 1/1997 | Harwood et al. | |
| 5,717,173 | A | | 2/1998 | Gerber et al. | |
| 5,816,361 | A | | 10/1998 | Gerber | |
| 5,907,904 | A | | 6/1999 | Gerber et al. | |
| 5,949,035 | A | * | 9/1999 | Herold | 181/282 |
| 2001/0037836 | A1 | * | 11/2001 | Yoshitoshi et al. | 138/115 |

* cited by examiner

STAMPED-FORMED MUFFLER APPARATUS AND ASSEMBLY PROCESS

This Application is a 371 of PCT/US 99/01975 filed Jan. 29, 1999 which claims benefit of Provisional No. 60/073, 151 filed Jan. 30, 1998.

BACKGROUND AND SUMMARY OF THE INVENTION

The present invention relates to mufflers used in vehicles to reduce the noise associated with engine exhaust gases. More particularly, the present invention relates to stamp-formed mufflers.

Internal combustion engines produce noise that must often be quieted in some manner to satisfy vehicle drivers and state regulations. Mufflers are generally included in vehicle exhaust systems to attenuate this noise to acceptable levels. Such mufflers are often formed of metal components coupled together in a configuration suitable to attenuate the exhaust noise.

According to the present invention, a muffler body is provided that is formed from a single sheet of material. The sheet of material includes first, second, and third folds that partition the sheet into first, second, third, and fourth portions. The first and fourth portions define first and second outer shells that cooperate to define a chamber therebetween. The second and third portions cooperate to define first and second inner plates that define a baffle. The baffle defines an exhaust passage and partitions the chamber into first and second subchambers.

According to a preferred method of the invention, a method is provided for producing a muffler body. The method includes the step of providing a sheet of material and three steps for folding the sheet. The sheet has a first, second, third, and fourth portions. The first folding step includes folding the sheet so that the first portion of the sheet defines a first outer shell and the second portion defines a first inner plate that cooperates with the first outer shell to form a subchamber therebetween. The second folding step includes folding the sheet so that the third portion of the sheet defines a second inner plate and the fourth portion of the sheet defines a second outer shell that cooperates with the second inner plate to define a second subchamber. The third folding step includes folding the sheet so that first inner plate is positioned to lie against the second inner plate.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 9 is a perspective view of the alternative embodiment muffler body partially formed and stamped from a single sheet of material showing the partially formed muffler body including four portions defining a first inner plate formed to include a first exhaust channel, a first outer shell, a second outer shell, and a second inner plate formed to include a second exhaust channel;

FIG. 10 is an end elevational view of the partially formed muffler body of FIG. 9 showing a first direction in which the first inner plate is folded relative to the first outer shell and a second direction in which the second inner plate is folded relative to the second outer shell;

FIG. 11 is an end elevational view of the partially formed muffler body of FIG. 9 showing the first inner plate folded relative the first outer shell in the first direction, the second inner plate folded relative the second outer shell in the second direction, and a third direction in which the first inner plate and first outer shell are folded relative to the second inner plate and the second outer shell;

FIG. 12 is an end elevational view of the partially formed muffler body of FIG. 11 showing the first inner plate and first outer shell partially folded relative to the second inner plate and the second outer shell in the third direction; and FIG. 13 is an end elevational view of the muffler body of FIG. 12 showing the muffler body completely folded with the first outer shell and the first inner plate cooperating to form a first subchamber, the second outer shell and the second inner plate cooperating to form a second subchamber, and the first exhaust channel and the second exhaust channel cooperating to form an exhaust passage.

DETAILED DESCRIPTION OF THE DRAWINGS

Figure 1:
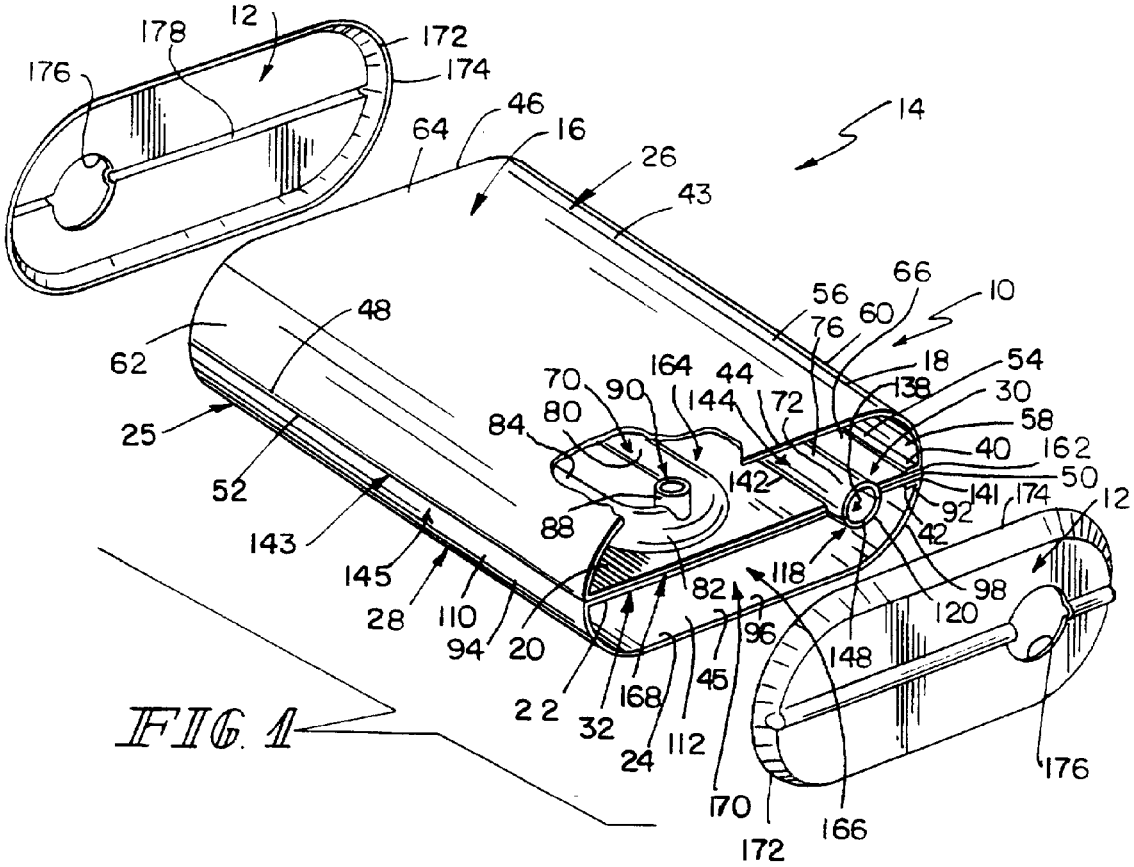
FIG. 1 is an exploded perspective view of a muffler, with portions broken away, showing the muffler including a muffler body and spaced apart end caps.
Figure 2:
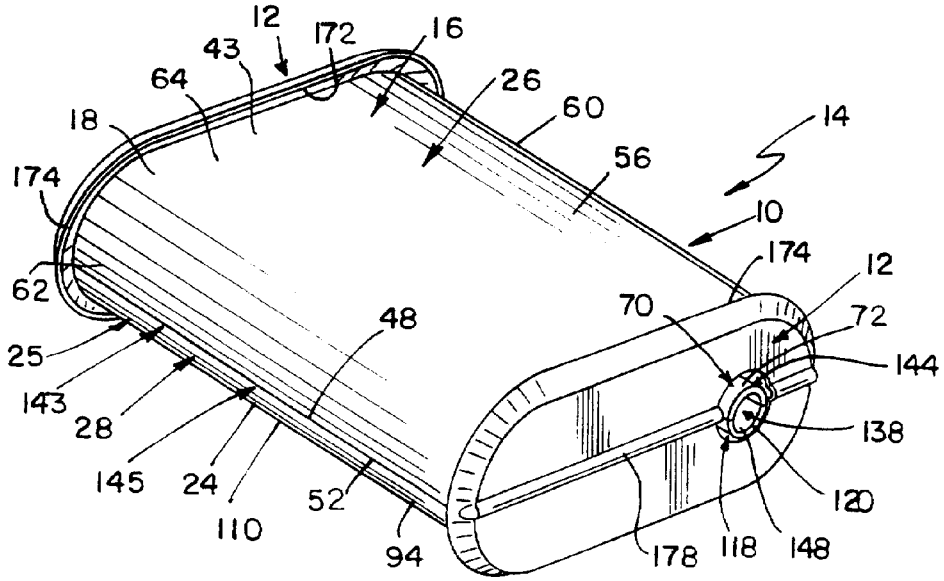
FIG. 2 is a perspective view similar to FIG. 1 showing the end caps mounted on the muffler body.
Figure 3:
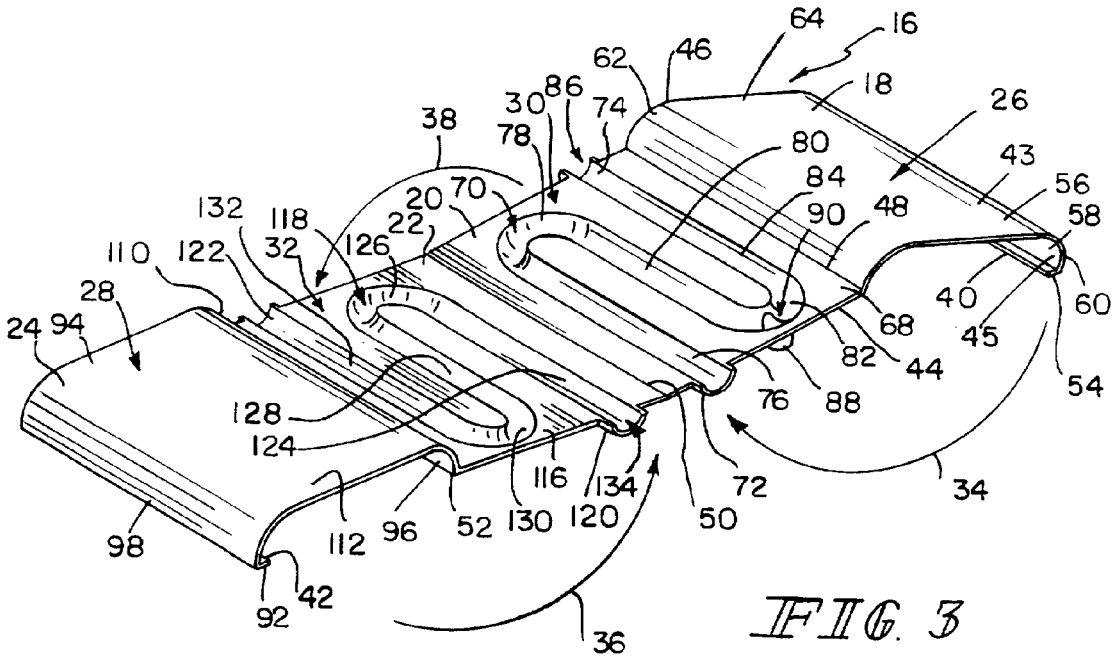
FIG. 3 is a perspective view of the muffler body partially formed and stamped from a single sheet of material showing the partially formed muffler body including four portions defining a first outer shell, a first inner plate formed to include a first exhaust channel, a second inner plate formed to include a second exhaust channel, and a second outer shell.

A pair of end caps 12 is coupled to a muffler body 10 to form a vehicle muffler 14 as shown, for example, in FIGS. 1 and 2. Muffler body 10 is formed from a single stamped and folded sheet or piece 16 of metal or other material. Sheet 16 is stamped and partitioned into first, second, third, and fourth portions 18, 20, 22, 24 that are integrally coupled to one another as shown in FIG. 3. All of these portions 18, 20, 22, 24 remain integrally coupled together as a continuous sheet 16 as sheet 16 is shaped into muffler body 10 by folding portions 18, 20, 22, 24 relative to each other so that two of the portions define an outer shell 25 of muffler body 10 and the other two portions define a baffle 168 of muffler body 10.

Figure 4:
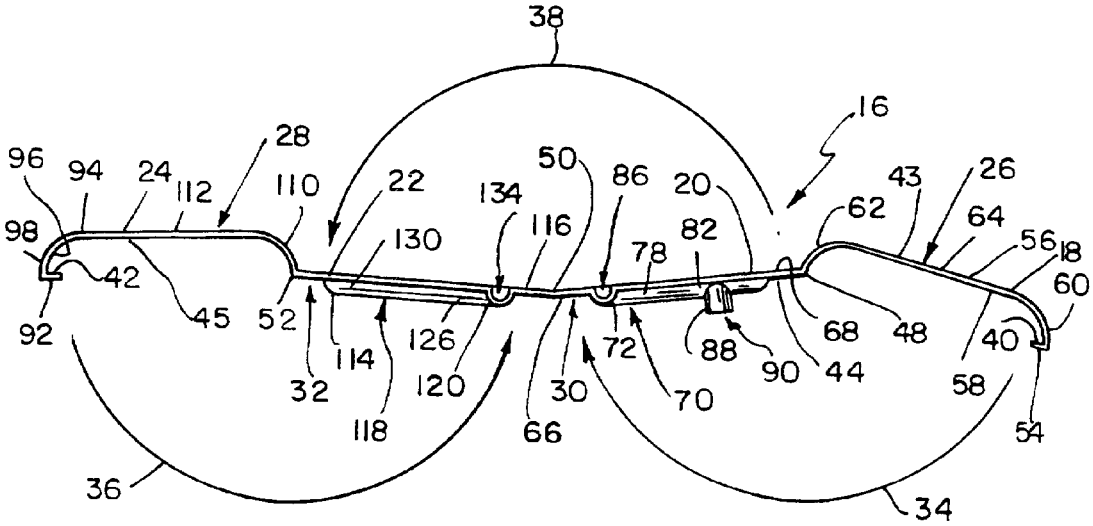
FIG. 4 is an end elevational view of the partially formed muffler body of FIG. 3.
Figure 7:
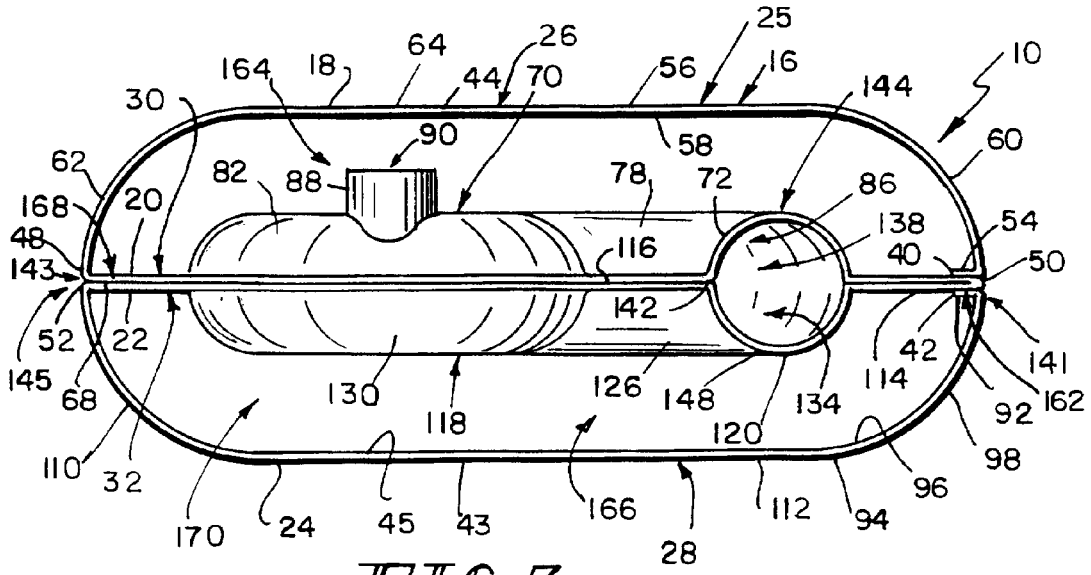
FIG. 7 is an end elevational view of the muffler body of FIG. 6 showing the muffler body completely folded with the first outer shell and the first inner plate cooperating to define a first subchamber, the second outer shell and the second inner plate cooperating to define a second subchamber, and the first and second exhaust channels cooperating to define an exhaust passage.

First and fourth portions 18, 24 are stamped to define respective first and second outer shells 26, 28 and second and third portions 20, 22 are stamped to define respective first and second inner plates 30, 32. As shown in FIG. 4, first outer shell 26 is folded in direction 34 about a first fold line 48, second inner plate 32 is folded in direction 38 about a second fold line 50, and second outer shell 28 is folded in direction 36 about a third fold line 52 to form muffler body 10 as shown in FIG. 7 from single sheet 16.

Sheet 16 includes a first end 40, a second end 42 spaced apart from first end 40, a first edge 44 extending between first and second ends 40, 42, and a second edge 46 spaced apart from first edge 44 and extending between first and second ends 40, 42. Sheet 16 also includes a first surface 43 and an opposite second surface 45 facing away from first surface 43.

Sheet 16 is shaped to define contours, passageways, and openings to aid in the functioning of muffler body 10 in muffler 14. Before sheet 16 is folded, sheet 16 is stamped or hydroformed through a series of dies in a progressive operation to include, among other features, first fold line 48 spaced apart from first end 40 and extending between first and second edges 44, 46, second fold line 50 positioned to lie between first fold line 48 and second end 42 and extending between first and second edges 44, 46, and third fold line 52 positioned to lie between second fold line 40 and second end 42 and extending between first and second edges 44, 46. According to an alternative embodiment of muffler body 10, fold lines 48, 50, 52 may be formed as a result of the folding steps or another forming process.

First outer shell 26 extends between first end 40 of sheet 16 and first fold line 48. First inner plate 30 extends between first fold line 48 and second fold line 50. Second inner plate extends between second fold line 50 and third fold line 52. Second outer shell 28 extends between third fold line 52 and second end 42 of sheet 16.

Figure 5:
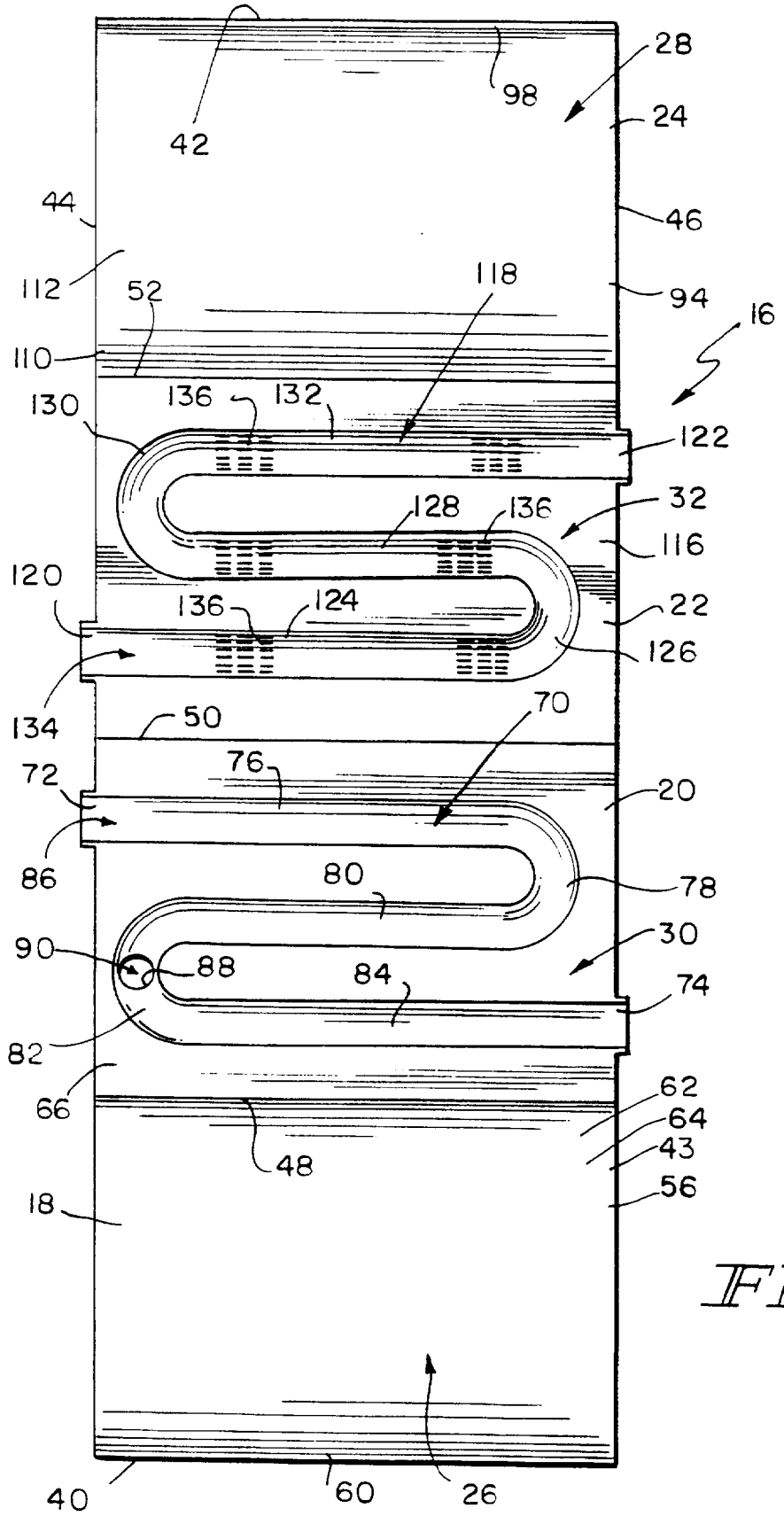
FIG. 5 is a top plan view of the partially formed muffler body of FIG. 3.

First outer shell 26 is shaped to include various functional contours and edges as shown, for example, in FIGS. 3–5. First end 40 of sheet 16 is formed to include a first flange 54 extending along first end 40 between first and second edges 44, 46. First outer shell 26 is formed to include an outward-facing surface 56, an inward-facing surface 58 facing away from outward-facing surface 56, a first curved portion 60 extending between first and second edges 44, 46 adjacent to first end 40, a second curved portion 62 extending between first and second edges 44, 46 adjacent to first fold line 48, and a substantially flat portion 64 extending between first and second curved portions 60, 62 of first outer shell 26 and first and second edges 44, 46.

First inner plate 30 is also formed to include various shapes and contours to aid its functionality as a baffle and passage as shown, for example, in FIGS. 3–5. First inner plate 30 is formed to include an outward-facing surface 66, an inward-facing surface 68 facing away from outward-facing surface 66, a first half tube 70 including an inlet portion 72, an outlet portion 74 spaced apart from inlet portion 72, a first straight portion 76 situated adjacent to inlet portion 72, a first bend 78 situated adjacent to first straight portion 76, a second straight portion 80 communicating with first straight portion 76 through first bend 78, a second bend 82 connected to second straight portion 80, and a third straight portion 84 extending between second bend 82 and outlet portion 74.

First half tube 70 defines a first channel 86 extending from inlet portion 72 to outlet portion 74 via first straight portion 76, first bend 78, second straight portion 80, second bend 82, and third straight portion 84. First bend 78 of first half tube 70 is also formed to include a tuning throat 88 having a throat aperture 90.

Similar to first outer shell 26, second outer shell 28 is also shaped to include various functional contours and edges as shown, for example, in FIGS. 3–5. Second end 42 of sheet 16 is formed to include a second flange 92 extending along second end 42 between first and second edges 44, 46. Second outer shell 28 is formed to include an outward-facing surface 94, an inward-facing surface 96 facing away from outward-facing surface 94, a first curved portion 98 extending between first and second edges 46, 48 adjacent to second end 42, a second curved portion 110 extending between first and second edges 46, 48 adjacent to third fold line 52, and a substantially flat portion 112 extending between first and second curved portions 98, 110 of second outer shell 28 and first and second edges 46, 48.

Similar to first inner plate 30, second inner plate 32 is also formed to include various shapes and contours to aid its functionality as a baffle and passage as shown, for example, in FIGS. 3–5. Second inner plate 32 is formed to include an outward-facing surface 114, an inward-facing surface 116 facing away from outward-facing surface 114, a second half tube 118 including an inlet portion 120, an outlet portion 122 spaced apart. from inlet portion 120, a first straight portion 124 situated adjacent to inlet portion 120, a first bend 126 situated adjacent to first straight portion 124, a second straight portion 128 communicating with first straight portion 124 through a first bend 126, a second bend 130 connected to second straight portion 128, and a third straight portion 132 extending between second bend 130 and outlet portion 122.

Second half tube 118 defines a second channel 134 extending from inlet portion 120 to outlet portion 122 via first straight portion 124, first bend 126, second straight portion 128, second bend 130, and third straight portion 132. Second half tube 118 is also formed to include a series of perforations or louvers 136 extending from first surface 43 to second surface 45 in first, second, and third straight portions 124, 128, 132 as shown in FIG. 5. However, series of perforations 136 may also be formed along the other portions of second half tube 118 or other portions of muffler body 10.

Figure 6:
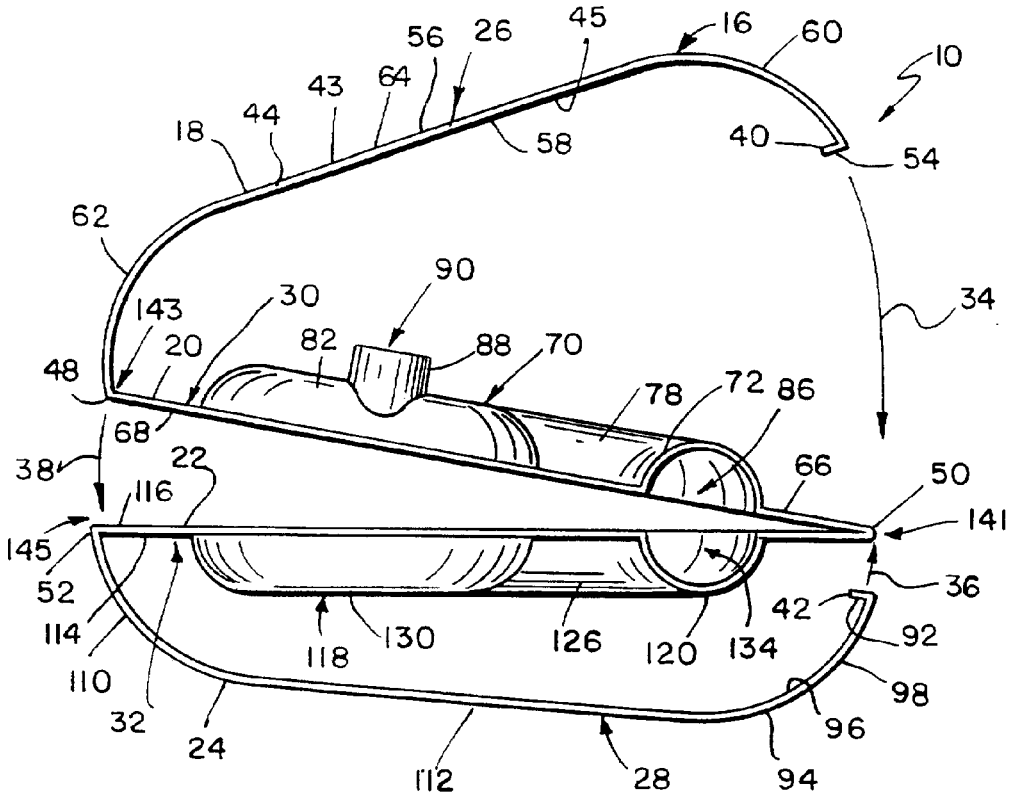
FIG. 6 is an end elevational view of the partially formed muffler body of FIG. 3 showing the first outer shell folded about a first fold line relative to the first inner plate, the first inner plate folded about a second fold line relative to the second inner plate, and the second outer shell folded about a third fold line relative to the second inner plate.

Sheet 16 is folded in three steps to complete the formation of muffler body 10 as shown in FIGS. 3, 4, and 6 so that portions 18, 20, 22, 24 lay over one another. After sheet 16 has been stamped, first inner plate 30 is folded relative to second inner plate 32 along second fold line 50 in direction 38 so that first inner plate 30 lies flat against second inner plate 32. After folding, inward-facing surface 68 of first inner plate 30 and inward-facing surface 116 of second inner plate 32 face each other as shown, for example, in FIGS. 1, 6, and 7; first and second inner plates 30, 32 create a margin therebetween defining a fold 141; and first and second channels 86, 134 cooperate to form a complete exhaust passage 138 through muffler body 10.

When muffler body 10 is completely folded in direction 38, as shown in FIG. 7, first inner plate 30 and second inner plate 32 cooperate to form first and second tube joints 140, 142 that extend along the length of first and second half tubes 70, 118, as shown, for example, in FIG. 7. First and second tube joints 140, 142 are spot-welded or bar-welded to join first and second half tubes 70, 118 to form a tube 144 that extends through muffler body 10 between first and second edges 44, 46. Tube 144 defines passage 138 including first and second channels 86, 134. Thus, tube 144 is formed from single sheet 16 of material.

Passage 138 forms a flow path for exhaust gases flowing through muffler body 10. Inlet portion 72 of first half tube 70 and inlet portion 120 of second half tube 118 define an inlet 148 entering passage 138. First straight portion 76 of first half tube 70 and first straight portion 124 of second half tube 118 define a first straight portion 150 of passage 138. First bend 78 of first half tube 70 and first bend 126 of second half tube 118 define a first bend portion 152 of passage 138. Second straight portion 80 of first half tube 70 and second straight portion 128 of second half tube 118 define a second straight portion 154 of passage 138. Second bend 82 of first half tube 70 and second bend 130 of second half tube 118 define a second bend portion 156 of passage 138. Third straight portion 84 of first half tube 70 and third straight portion 132 of second half tube 118 define a third straight portion 158 of passage 138. Outlet portion 74 of first half tube 70 and outlet portion 122 of second half tube 118 define an outlet 160 exiting passage 138.

The second and third folding steps form subchambers surrounding tube 144 for attenuating noise. In the second folding step, first outer shell 26 is folded relative to first inner plate 30 along first fold line 48 in direction 34. After folding, inward-facing surface 58 of first outer shell 26 faces outward-facing surface 66 of first inner plate 30 as shown, for example, in FIGS. 6 and 7 and first outer shell 26 and first inner plate 30 create a margin therebetween defining a fold 143.

In the third folding step, second outer shell 28 is folded relative to second inner plate 32 along third fold line 52 in direction 36. After folding, inward-facing surface 96 of second outer shell 28 faces outward-facing surface 1 14 of second inner plate 32 as shown, for example, in FIGS. 6 and 7; second outer shell 28 and second inner plate 32 create a margin therebetween defining a fold 145; and first and second outer shells 26, 28 cooperate to define complete outer shell 25. According to alternative embodiments of the present invention, the folding steps may occur in any order.

When muffler body 10 is completely folded in directions 34, 36, 38, as shown in FIG. 7, first and second flanges 54, 92 are mechanically folded, welded, or coupled by any process to form a flange joint 162. Muffler body 10 is also coupled at several locations along first and third fold lines 48, 52 by tack-welding, any other method of spot-welding, or any other appropriate method of coupling.

The coupling of first and second tube joints 140, 142, first and second flanges 54, 92, and flange joint 162 permits first outer shell 26 and first inner plate 30 to cooperate to define a first subchamber 164 and second inner plate 32 and second outer shell 28 to cooperate to define a second subchamber 166. First inner plate 30 and second inner plate 32 also cooperate to define baffle 168 that separates first subchamber 164 from second subchambers 166. First and second outer shells 26, 28 cooperate to define outer shell 25 so that first and second subchambers 164, 166 define a chamber 170 defined by outer shell 25. Thus, first and second subchambers 164, 166 and passage 138 are formed using only single sheet 16.

As shown in FIG. 7, first outer shell 26, first inner plate 30, second inner plate 32, and second outer shell 28 are integral with one another as they are all formed of one piece of material 16. Thus, first outer shell 26 is integrally connected to first inner plate 30; first inner plate 30 is integrally connected to second inner plate 32; and second inner plate 32 is integrally connected to second outer shell 28. Furthermore, first outer shell 26, first inner plate 30, second inner plate 32, and second outer shell 28 are integrally coupled to one another. For example, first outer shell 26 is integrally coupled to first inner plate 30, second inner plate 32, and second outer shell 28.

To complete muffler 14, muffler body 10 is capped to form a complete unit. First and second subchambers 164, 166 are enclosed by external wraps (not shown) or mechanically locked end caps 12 coupled to muffler body 10 at first and second edges 44, 46 as shown, for example, in FIG. 2. End caps 12 are attached to muffler body 10 using a "cap spinning" technique. Cap spinning is a mechanical locking process by which an edge 172 of each end cap 12 is progressively rolled back onto muffler body 10 that then binds muffler body 10 and end caps 12 together.

Conventional welding, lock seams, or any other methods of enclosing the muffler body may be used to enclose the muffler body.

Each end cap 12 includes features that aid in the assembly and operation of muffler 14. Each end cap 12 includes an outer perimeter 174 having edge 172 that couples to muffler body 10 at first and second edges 44, 46 on first and second outer shells 26, 28 when each end cap 12 is rolled onto muffler body 10 using the cap spinning technique. Furthermore, each end cap 12 is formed to include a muffler body-receiving aperture 176 for receiving an outlet 148 or inlet 160 of muffler body 10 as shown, for example, in FIG. 2 and a baffle-receiving groove 178 for receiving a first or second edge 44, 46 located along first and second inner plates 30, 32. After coupling end caps 12 to first and second edges 44, 46 of muffler body 10, muffler 14 is an enclosed unit with only inlet 160 and outlet 148 of tube passage 138 permitting flow of exhaust gases along a serpentine direction 180 through muffler body 10 as shown in FIG. 8.

Thus, according to the preferred embodiment of the present invention, muffler body 10 is formed to include passage 138, first subchamber 164, second subchamber 166, and baffle 168 from a single sheet of material. End caps 12 or other enclosing structure are added to complete muffler 14. Because passage 138 is formed in first and second inner plates 30, 32, no tubing or pipe (not shown) is necessary to facilitate exhaust flow. In alternative embodiments, additional louvers or tuning throats can be formed in the muffler body to adapt the tuning characteristics of the muffler when necessary. For example, an additional tuning throat could be formed in the second inner plate at the second bend.

Figure 8:
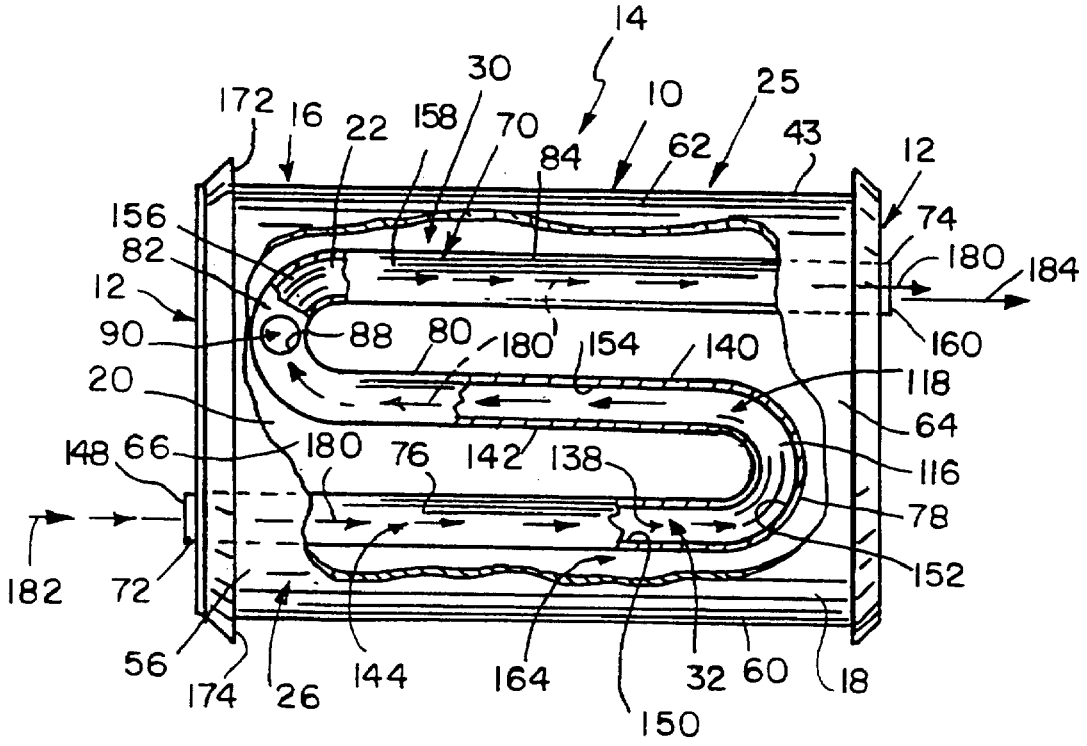
FIG. 8 is a top plan view of the assembled muffler of FIG. 2, with portions broken away, showing the first and second inner plates cooperating to define an inlet into the exhaust passage and an outlet out of the exhaust passage and the exhaust passage having a serpentine shape as it winds through the muffler body.

Exhaust gas and noise from a combustion engine (not shown) travels through an exhaust system (not shown) to muffler 14, enters inlet 160 of passage 138 in direction 182, passes through muffler 14 via passage 138 in direction 180, and exits muffler 14 through outlet 148 of passage 138 in direction 184 as shown in FIG. 8. During its travel through passage 138 of muffler body 10, the noise of the combustion engine is attenuated, absorbed, and reflected back to the engine by muffler 14.

First subchamber 164 defines a Helmholtz tuning chamber to attenuate low-frequency noise. Throat aperture 90 permits the transmission of low-frequency noise into first subchamber 164 where this low-frequency noise is attenuated and absorbed. High-frequency noise is attenuated by second subchamber 166. Series of perforations 136 permits the transmission of high-frequency noise into second subchamber 166 where this high-frequency noise is attenuated and absorbed. Noise is also reflected back to the engine by passage 138. First and second bend portions 152, 156 of passage 138 reflect noise from the combustion engine back towards the engine so that this component of the noise does not exit muffler 14 to the atmosphere.

Muffler 14 is also described in U.S. Provisional Application Serial No. 60/073,151, filed Jan. 30, 1998, which is expressly incorporated by reference herein.

Figure 9:
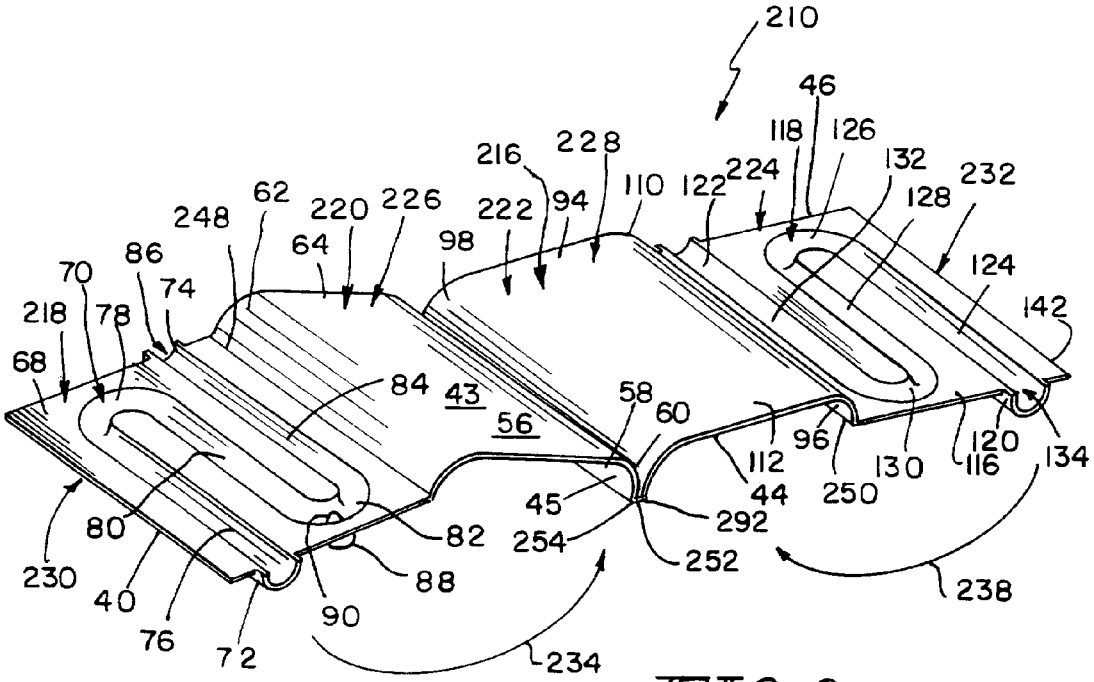
FIGS. 9–13 show an alternative embodiment of a muffler body.

As shown in FIGS. 9–13, an alternative muffler body 210 is also formed from a single stamped and folded sheet 216 of metal or other material. Sheet 216 is similar to sheet 16 of muffler body 10. Identical components of muffler bodies 10, 210 are referred to using identical reference numbers. Sheet 216 is stamped and partitioned into first, second, third, and fourth portions 218, 220, 222, 224 that remain integrally coupled to one another as sheet 216 as shown in FIG. 9.

Figure 10:
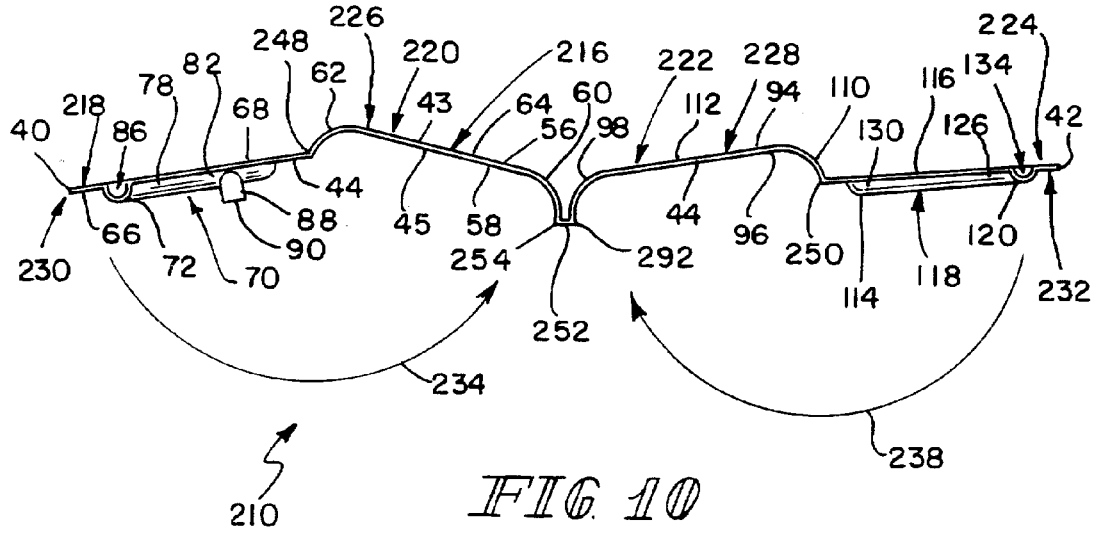
Figure 11:
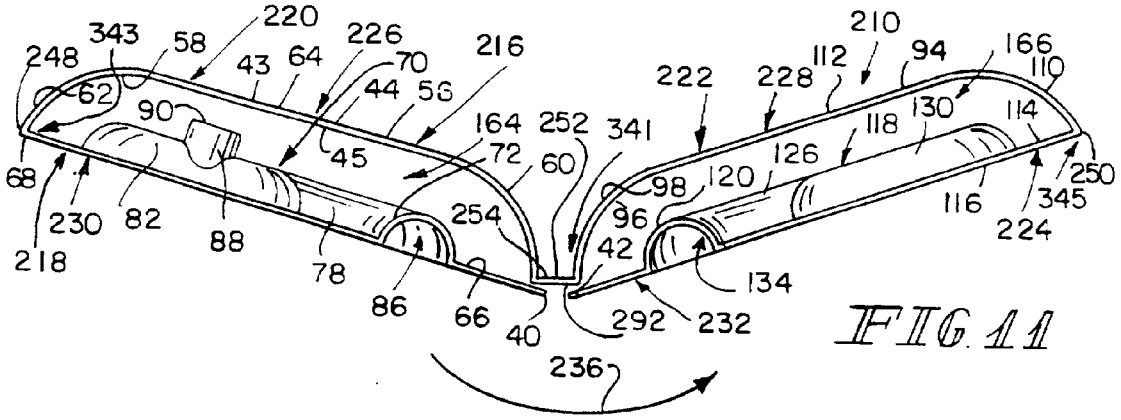
Figure 12:
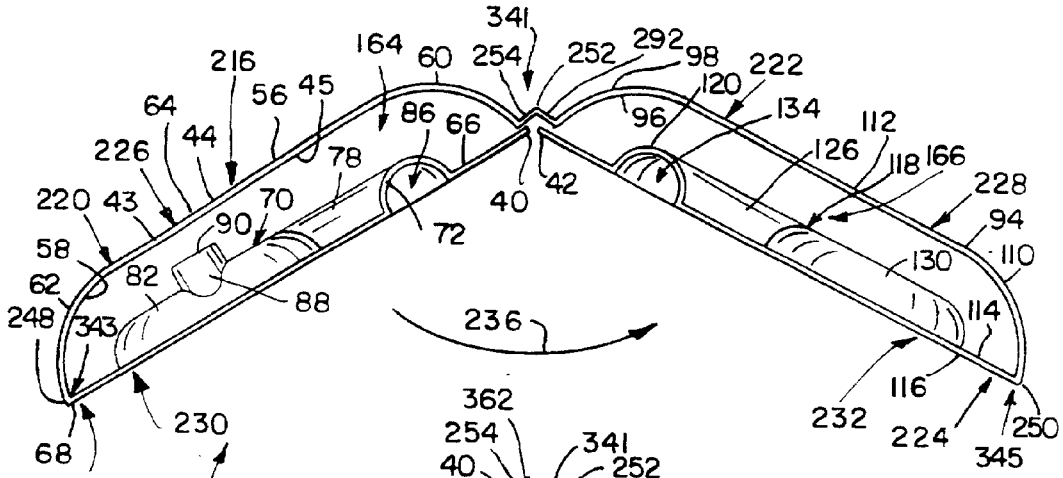

First and fourth portions 218, 224 are stamped to define respective first and second inner plates 230, 232 and second and third portions 220, 222 are stamped to define respective first and second outer shells 226, 228. As shown in FIG. 10, first inner plate 230 is folded in direction 234 about a first fold line 248, second inner plate 232 is folded in direction 238 about a second fold line 250 to form partially formed muffler body 210 shown in FIG. 11. First inner plate 230 and first outer shell 226 are folded in direction 236 about a third fold line 252 relative to second inner plate 232 and second outer shell 228 to form muffler body 210 as shown in FIG. 12 from single sheet 216.

First inner plate 230 is substantially similar to inner plate 30 of muffler body 10. First inner plate 230 is integrally connected to first outer shell 226 along first fold line 248.

First outer shell 226 is substantially similar to first outer shell 26 of muffler body 10. First outer shell 226 includes a first flange 254 extending between first and second edges 44, 46. First outer shell 226 is integrally connected to first inner plate 230 along first fold line 248 and second outer shell 228 along third fold line 252 at first flange 254 as shown in FIG. 9.

Second outer shell 228 is substantially similar to second outer shell 28 of muffler body 10. Second outer shell 228 includes a second flange 292 extending between first and second edges 44, 46. Second outer shell 228 is integrally connected to first flange 254 of first outer shell 226 along third fold line 252 at second flange 292 and second inner plate 232 along second fold line 250.

Second inner plate 232 is substantially similar to inner plate 32 of muffler body 10. First inner plate 232 is integrally connected to second outer shell 228 along second fold line 250.

Sheet 216 is folded in three steps to complete the formation of muffler body 210 as shown in FIGS. 10–13 so that portions 218, 220, 222, 224 lay over one another. After sheet 216 has been stamped, first inner plate 230 is folded relative to first outer shell 226 along first fold line 248 in direction 248. After folding, outward-facing surface 66 of first inner plate 230 and inward-facing surface 58 of first outer shell 226 face each other as shown, for example, in FIG. 11 and first outer shell 226 and first inner plate 230 create a margin therebetween defining a fold 343.

In the second folding step, second inner plate 232 is folded relative to second outer shell 228 along third fold line 250 in direction 238 as shown in FIG. 10. After folding, inward-facing surface 96 of second outer shell 228 faces outward-facing surface 114 of second inner plate 232 as shown, for example, in FIG. 11 and second outer shell 234 and second inner plate 232 create a margin therebetween defining a fold 345.

In the third folding step, first inner plate 230 and first outer shell 226 are folded relative to second inner plate 232 and second outer shell 228 along second fold line 252 in direction 236, as shown in FIG. 12, so that first inner plate 230 lies flat against second inner plate 232. After folding, inward-facing surface 68 of first inner plate 230 and inward-facing surface 116 of second inner plate 232 face each other as shown, for example, in FIG. 13; first and second outer shells, 226, 228 create a margin therebetween defining a fold 341; first and second channels 86, 134 cooperate to form a complete exhaust passage 138 through muffler body 210; and first and second outer shells 226, 228 cooperate to define complete outer shell 25.

Figure 13:
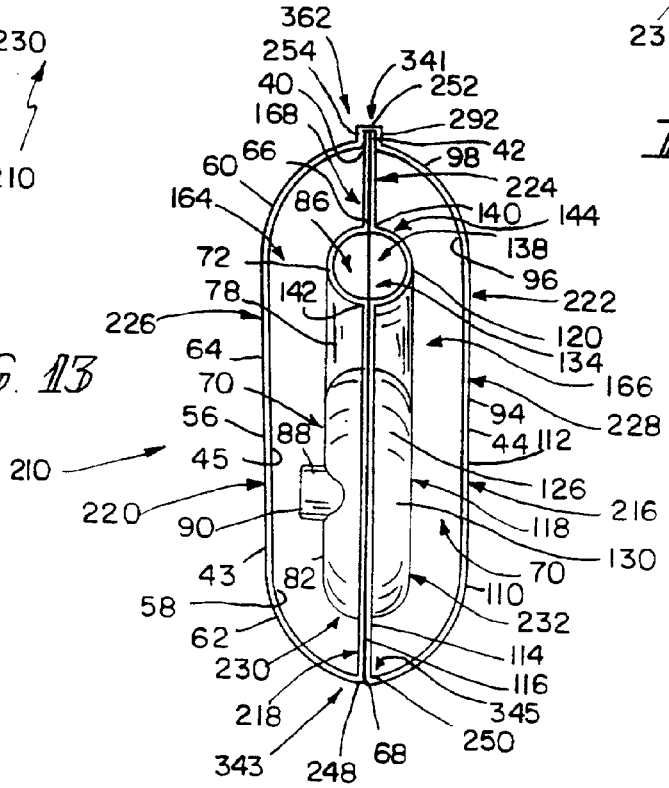

When muffler body 10 is completely folded in direction 236, as shown in FIG. 13, first inner plate 230 and second inner plate 232 are joined in a manner similar to first and second inner plates 30, 32 to form tube 144 and define passage 138. When muffler body 210 is completely folded in directions 234, 238, 236, as shown in FIG. 13, first and second flanges 254, 292 are mechanically folded, welded, or coupled by any process to form a flange joint 362. Muffler body 10 is also coupled at several locations along first and third fold lines 248, 250 by tack-welding, any other method of spot-welding, or any other appropriate method of coupling.

The coupling of first and second inner plates 230, 232 and first and second outer shells 226, 228 permits first outer shell 226 and first inner plate 230 to cooperate to define first subchamber 164 and second inner plate 232 and second outer shell 228 to cooperate to define second subchamber 166. First inner plate 230 and second inner plate 232 also cooperate to define baffle 168 that separates first subchamber 164 from second subchambers 166. First and second subchambers 164, 166 cooperate to define a chamber 170 between first and second outer shells 226, 228. Thus, first and second subchambers 164, 166 and passage 138 are formed using only single sheet 216.

As shown in FIG. 13, first outer shell 226, first inner plate 230, second inner plate 232, and second outer shell 228 are integral with one another as they are all formed of one piece of material 216. Thus, first outer shell 226, first inner plate 230, second inner plate 232, and second outer shell 228 are integrally coupled to one another. For example, first inner plate 230 is integrally coupled to first outer shell 226, second outer shell 228, and second inner plate 232.

The scope of the disclosure is not limited to the folding steps and configurations of the outer shells and inner plates described for muffler bodies 10, 210. Other folding steps and positions of the outer shells and inner plates relative to one another are also within the scope of the disclosure to form integral outer shells and inner plates from a single sheet of material.

Although the invention has been described in detail with reference to certain preferred embodiments, variations and modifications exist within the scope and spirit of the invention as described and defined in the following claims.

What is claimed is:

1. A muffler comprising a first end cap having an internal groove, a second end cap having an internal groove and lying in opposing, spaced-apart relation to the first end cap, and a muffler body located between the first and second end caps and formed to include a first opened end closed by the first end cap and a second opened end closed by the second end cap, a sheet of material including first, second, and third folds partitioning the sheet into first, second, third, and fourth portions, the first portion defining a first outer shell, the fourth portion defining a second outer shell cooperating with the first portion and the first and second end caps to define a chamber therebetween, the second and third portions cooperating to define a baffle partitioning the chamber defined by the first and second outer shells into first and second subchambers with grooves of the first and second end caps receiving the baffle, the second and third portions cooperating to define an exhaust passage therebetween.

2. A muffler comprising a muffler body including an outer shell and an inner plate positioned to lie within the outer shell, the inner plate including a first edge and a second edge spaced apart from the first edge, a first end cap coupled to the muffler body, the first end cap including a groove configured to receive the first edge of the inner plate, and a second end cap coupled to the muffler body, the second end cap including a groove configured to receive the second edge of the inner plate.

3. The muffler of claim 2, wherein the inner plate is integral with outer shell.

4. The muffler of claim 3, wherein the inner plate includes a tube including an inlet portion having an inlet and an outlet portion having an outlet, the first end cap includes an aperture configured to communicate with the inlet of the tube, the second end cap includes an aperture configured to communicate with the outlet of the tube.

5. The muffler of claim 4, wherein the inlet portion of the tube extends through the aperture of the first end cap.

6. The muffler of claim 4, wherein the outlet portion of the tube extends through the aperture of the second end cap.

7. A method for producing a muffler, the method including the steps of providing a sheet of material having a first portion, a second portion, a third portion, an a fourth portion, folding the sheet so that the first portion of the sheet defines a first outer shell and the second portion defines a first inner plate that cooperates with the first outer shell to form a first subchamber therebetween, folding the sheet so that the third portion of the sheet defines a second inner plate and the fourth portion of the sheet defines a second outer shell that cooperates with the second inner plate to define a second subchamber, folding the sheet so that the first inner plate is positioned to lie against the second inner plate, coupling a first grooved end cap to the sheet of with the groove receiving the inner plates material to close a first end opening into the first subchamber and a first end opening into the second subchamber, and coupling a grooved second end cap to the sheet of material with the groove receiving the inner plates to close a second end opening into the first subchamber and a second end opening into the second subchamber.

8. The method of claim 7, further comprising the step of stamping the first inner plate to include a tube cooperating with the second inner plate to define a passage therebetween when the first inner plate is positioned to lie against the second inner plate.

9. The method of claim 8, further comprising the steps of providing a tuning throat and coupling the tuning throat to the first inner plate.

10. The method of claim 7, wherein the first outer shell includes a first portion integrally coupled to the first inner plate and a second portion spaced apart from the first portion and the method further comprises the step of coupling the second portion of the first outer shell to the first inner plate.

11. The method of claim 7, wherein the first inner plate includes a first portion coupled to the first outer shell and a second portion spaced apart from the first portion, the second inner plate including a first portion coupled to the second outer shell and a second portion spaced apart from the first portion of the second outer shell, and further comprising the step of coupling the second portion of the first inner plate to the second portion of the second inner plate.

12. The muffler of claim 1, wherein the sheet of material includes a first edge arranged to mate with the first end cap.

13. The muffler of claim 12, wherein the second portion includes a first half tube defining an exhaust channel and an extended portion and the first half tube extends beyond the first edge included in the second portion.

14. The muffler of claim 13, wherein the first end cap is formed to include an aperture and the extended portion of the first half tube extends through the aperture.

15. The muffler of claim 14, wherein the first end cap further includes a groove and a section of the first edge defined by the second and third portions of the sheet of material extend into the groove formed in the first end cap.

16. The muffler of claim 13, wherein the third portion includes a second half tube defining an exhaust channel and mating with the first half tube included in the second portion to define an exhaust passageway therebetween and an extended portion of the second half tube extends beyond the first edge included in the third portion.

17. The muffler of claim 16, wherein the first end cap is formed to include an aperture and the extended portions of the first and second tube halves extend through the aperture.

18. The muffler of claim 17, wherein the first end cap further includes a groove and a section of the first edge defined by the second and third portions of the sheet of material extend into the groove formed in the first end cap.

19. The muffler of claim 12, wherein the first end cap further includes a groove and a section of the first edge defined by the second portion of the sheet of material extends into the groove formed in the first end cap.

20. The muffler of claim 19, wherein the first end cap further includes a wall formed to include the groove and a perimeter edge appended to a peripheral portion of the wall and coupled to an exterior surface of first and fourth portions of the sheet of material to retain the section of the first edge in the groove formed in the first end cap.

21. The muffler of claim 19, wherein another section of the first edge defined by the third portion of the sheet of material also extends into the groove formed in the first end cap.

22. The muffler of claim 21, wherein the first end cap further includes a wall formed to include the groove and a perimeter edge appended to a peripheral portion of the wall and coupled to an exterior surface of the first and fourth portions of ht sheet of material to retain the sections of the first edge in the groove formed in the end cap.

23. The muffler of claim 1, wherein the sheet of material includes a first edge arranged to extend into a groove formed in the first end cap and a second edge arranged to extend into a groove formed in the second end cap.

24. The muffler of claim 23, wherein each end cap further includes a wall formed to include the groove and a perimeter edge appended to a peripheral portion of the wall and coupled to an exterior surface of the first and fourth portions of the sheet of material.

25. The muffler of claim 23, wherein the second portion includes a first half tube, the third portion includes a second half tube that mates with the first half tube to define an exhaust passageway therebetween, and each of the first and second half tubes include an extended potion that extends through an aperture formed in the first end cap.

26. A muffler body comprising at least one grooved end cap, a muffler body formed to include a first opened end closed by at least one grooved end cap, a sheet of material including first, second, and third folds partitioning the sheet into first, second, third, and fourth portions, the first portion defining a first outer shell, the fourth portion defining a second outer shell cooperating with the first portion and the at least one end cap to define a chamber therebetween, the second and third portions cooperating to define a baffle partitioning the chamber defined by the first and second outer shells and the at least one end cap into first and second subchambers with the groove on the at least one end cap receiving the baffle, the second and third portions cooperating to define an exhaust passage therebetween.

27. The muffler of claim 26, wherein the sheet of material includes a first edge arranged to mate with the first end cap.

28. The muffler of claim 27, wherein the second portion includes a first half tube defining an exhaust channel and an extended portion and the first half tube extends beyond the first edge included in the second portion.

29. The muffler of claim 28, wherein the first end cap is formed to include an aperture and the extended portion of the first half tube extends through the aperture.

30. The muffler of claim 29, wherein the first end cap further includes a groove and a section of the first edge defined by the second and third portions of the sheet of material extend into the groove formed in the first end cap.

31. The muffler of claim 28, wherein the third portion includes a second half tube defining an exhaust channel and mating with the first half tube included in the second portion to define an exhaust passageway therebetween and an extended portion of the second half tube extends beyond the first edge included in the third portion.

32. The muffler of claim 31, wherein the first end cap is formed to include an aperture and the extended portions of the first and second tube halves extend through the aperture.

33. The muffler of claim 32, wherein the first end cap further includes a groove and a section of the first edge defined by the second and third portions of the sheet of material extend into the groove formed in the first end cap.

34. The muffler of claim 27, wherein the first end cap further includes a groove and a section of the first edge defined by the second portion of the sheet of material extends into the groove formed in the first end cap.

35. The muffler of claim 34, wherein the first end cap further includes a wall formed to include the groove and a perimeter edge appended to a peripheral portion of the wall and coupled to an exterior surface of first and fourth portions of the sheet of material to retain the section of the first edge in the groove formed in the first end cap.

36. The muffler of claim 34, wherein another section of the first edge defined by the third portion of the sheet of material also extends into the groove formed in the first end cap.

37. The muffler of claim 36, wherein the first end cap further includes a wall formed to include the groove and a perimeter edge appended to a peripheral portion of the wall and coupled to an exterior surface of the first and fourth portions of ht sheet of material to retain the sections of the first edge in the groove formed in the end cap.

38. The muffler of claim 26, wherein the sheet of material includes a first edge arranged to extend into a groove formed in the first end cap and a second edge arranged to extend into a groove formed in the second end cap.

39. The muffler of claim 38, wherein each end cap further includes a wall formed to include the groove and a perimeter edge appended to a peripheral portion of the wall and coupled to an exterior surface of the first and fourth portions of the sheet of material.

40. The muffler of claim 38, wherein the second portion includes a first half tube, the third portion includes a second half tube that mates with the first half tube to define an exhaust passageway therebetween, and each of the first and second half tubes include an extended potion that extends through an aperture formed in the first end cap.

* * * * *